US010894313B2

(12) United States Patent
Meyer

(10) Patent No.: US 10,894,313 B2
(45) Date of Patent: Jan. 19, 2021

(54) SYNCING APPARATUSES, PROCESS DOLLIES, AND CONVEYOR ASSEMBLIES

(71) Applicant: Toyota Motor Engineering & Manufacturing North America, Inc., Plano, TX (US)

(72) Inventor: Michael P. Meyer, Georgetown, KY (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 156 days.

(21) Appl. No.: 15/988,486

(22) Filed: May 24, 2018

(65) Prior Publication Data

US 2019/0358804 A1 Nov. 28, 2019

(51) Int. Cl.

| | |
|---|---|
| ***B25H 1/10*** | (2006.01) |
| ***B25H 1/08*** | (2006.01) |
| ***B25H 1/00*** | (2006.01) |

(52) U.S. Cl.

CPC ..... *B25H 1/10* (2013.01); *B25H 1/0007* (2013.01); *B25H 1/08* (2013.01)

(58) Field of Classification Search

CPC .. B25H 1/0007; B25H 1/10; B61J 1/00; B61J 1/12; B66F 9/07586

USPC ..... 269/56, 289 MR; 198/345.1, 345.2, 198/345.3; 104/168

See application file for complete search history.

(56) References Cited

U.S. PATENT DOCUMENTS

| | | | | |
|---|---|---|---|---|
| 5,134,940 | A | 8/1992 | Fujita et al. | |
| 5,513,428 | A | 5/1996 | Shiramizu et al. | |
| 6,164,430 | A * | 12/2000 | Nishimura | B65G 47/8815 198/345.1 |
| 7,484,616 | B2 | 2/2009 | Nakamura | |
| 8,011,491 | B2 | 9/2011 | Nakagawa et al. | |
| 8,162,302 | B2 | 4/2012 | Turner et al. | |
| 8,534,446 | B2 | 9/2013 | Stadler et al. | |
| 8,627,942 | B2 | 1/2014 | Terazawa et al. | |
| 8,708,131 | B2 * | 4/2014 | Fukano | B65G 43/00 198/345.1 |

FOREIGN PATENT DOCUMENTS

WO 2008122381 A2 2/2009

* cited by examiner

*Primary Examiner* — Lee D Wilson
*Assistant Examiner* — Alberto Saenz
(74) *Attorney, Agent, or Firm* — Dinsmore & Shohl LLP

(57) ABSTRACT

A syncing apparatus for synchronizing a process dolly to a conveyor includes a mounting frame and a sync arm. The mounting frame is configured to be mounted to a frame of the process dolly. The sync arm is coupled to the mounting frame and includes a wheel and a biasing member coupled to the wheel and configured to bias the wheel to an extended position. The wheel is configured to contact a contact feature of the conveyor to synchronize the process dolly to a movement of the conveyor when biased to the extended position. Compression of the biasing member moves the wheel to a retracted position wherein the wheel is configured to traverse the contact feature of the conveyor and the process dolly is unsynchronized from the movement of the conveyor.

20 Claims, 7 Drawing Sheets

SYNCING APPARATUSES, PROCESS DOLLIES, AND CONVEYOR ASSEMBLIES

TECHNICAL FIELD

The present specification generally relates to syncing apparatuses, process dollies, conveyor assemblies, and, more specifically, to syncing apparatuses, process dollies, and conveyor assemblies having synchronizing apparatuses for synchronizing process dollies to conveyors.

BACKGROUND

Process dollies are used in manufacturing processes to carry parts, tools, and the like for use along an assembly line. In particular, in the vehicle manufacturing industry, process dollies are configured to move at the same rate as a vehicle or vehicle component along an assembly line. For a process dolly to move at the same rate as a particular vehicle component, it must be synchronized to a portion of the conveyor assembly where the particular part is located. Conventionally, to sync a process dolly to a particular portion of the conveyor a block is coupled to the conveyor and the process dolly includes a urethane scraper that is positioned to contact the block. The contact between the urethane scraper and the block causes the process dolly to move along with the movement of the conveyor. However, such scrapers may wear out and become unreliable.

Accordingly, a need exists for alternative syncing apparatuses for synchronizing a process dolly to a motion of a conveyor.

SUMMARY

In one embodiment, a syncing apparatus for synchronizing a process dolly to a conveyor includes a mounting frame and a sync arm. The mounting frame is configured to be mounted to a frame of the process dolly. The sync arm is coupled to the mounting frame and includes a wheel and a biasing member coupled to the wheel and configured to bias the wheel to an extended position. The wheel is configured to contact a contact feature of the conveyor to synchronize the process dolly to a movement of the conveyor when biased to the extended position. Compression of the biasing member moves the wheel to a retracted position wherein the wheel is configured to traverse the contact feature of the conveyor and the process dolly is unsynchronized from the movement of the conveyor.

In another embodiment, a process dolly includes a frame and a syncing apparatus coupled to the frame and configured to synchronize the process dolly to a movement of a conveyor. The syncing apparatus includes a sync arm that includes a wheel and a biasing member coupled to the wheel. The biasing member biases the wheel to an extended position. The wheel is configured to contact a contact feature of the conveyor to synchronize the process dolly to the movement of the conveyor when biased to the extended position. Compression of the biasing member moves the wheel to a retracted position wherein the wheel is configured to traverse the contact feature of the conveyor and the process dolly is unsynchronized from the movement of the conveyor.

In yet another embodiment, a conveyor assembly includes a conveyor having a contact feature and a process dolly configured to be synchronized to a movement of the conveyor. The process dolly includes a frame and a syncing apparatus coupled to the frame and configured to synchronize the process dolly to the movement of the conveyor. The syncing apparatus includes a sync arm that includes a wheel and a biasing member coupled to the wheel. The biasing member biases the wheel to an extended position. The wheel is configured to contact the contact feature of the conveyor to synchronize the process dolly to the movement of the conveyor when biased to the extended position. Compression of the biasing member moves the wheel to a retracted position wherein the wheel is configured to traverse the contact feature of the conveyor and the process dolly is unsynchronized from the movement of the conveyor.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The figures generally depict a syncing apparatus for synchronizing a process dolly to a movement of a conveyor. In particular, syncing apparatuses according to the present disclosure generally include a wheel and a biasing member coupled to the wheel and configured to bias the wheel to an extended position. The conveyor may include a contact feature. The wheel may contact the contact feature such that the process dolly, to which the syncing apparatus is attached, moves with the contact feature of the conveyor. Then, the process dolly may move in synchronization with the conveyor due to contact between the syncing apparatus and the contact feature of the conveyor. When synchronization is no longer needed, force can be applied to the process dolly in a direction opposite the direction of movement of the conveyor. The contact feature may be positioned at such a height relative to the wheel that the force causes the wheel to roll over the contours of the contact feature while the biasing element allows the wheel of move to a retracted state such that the wheel remains in contact with the contact feature until it traverses completely past the contact feature. Accordingly, due to the rolling of the wheel over the contact feature, the syncing apparatus experiences much less wear than previous methods that used resilient urethane scrapers to contact conveyor contact features. Various embodiments of the syncing apparatus will be described in more detail herein.

Figure 1:
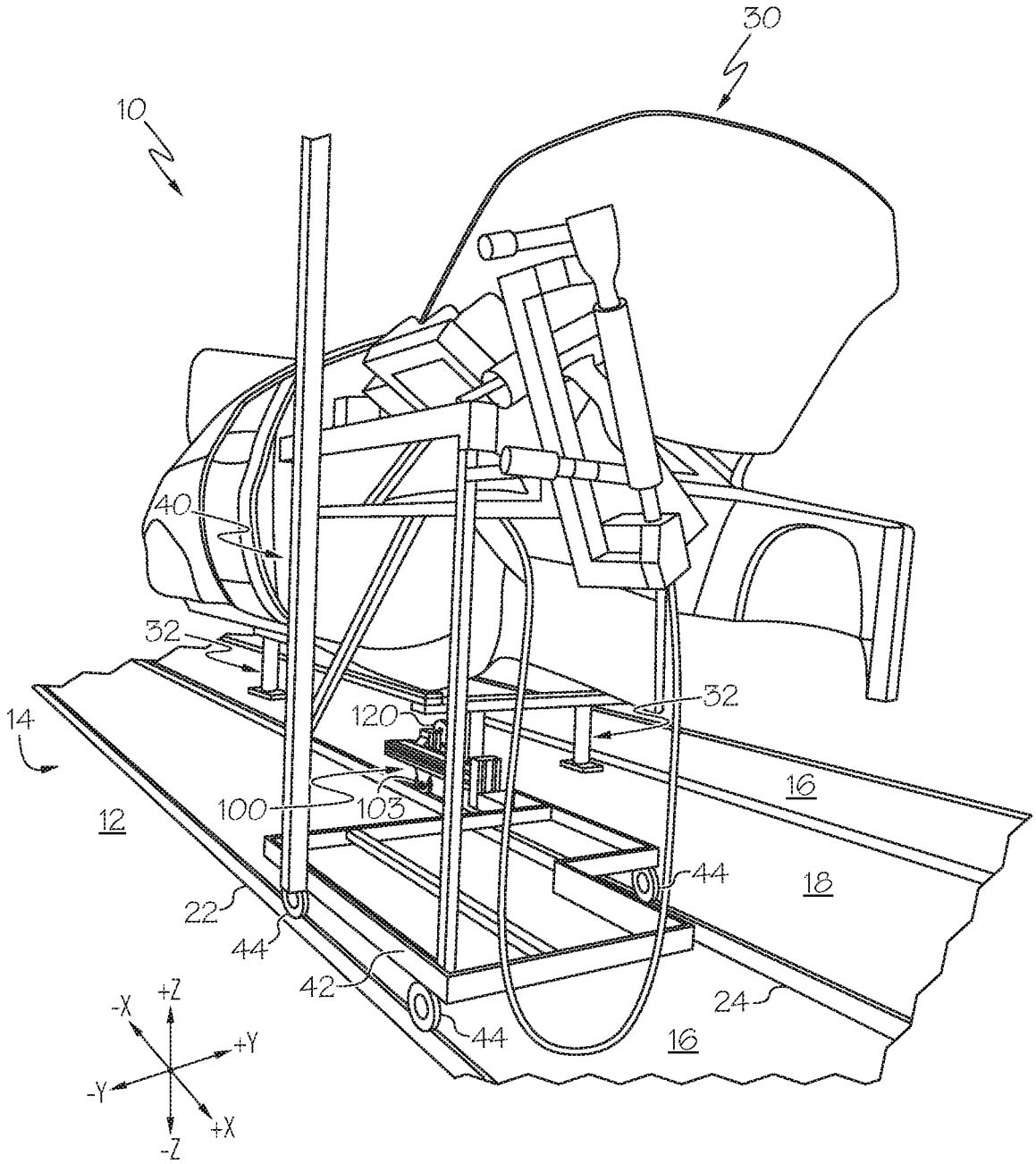
FIG. 1 depicts a perspective view of a conveyor assembly, according to one or more embodiments shown and described herein.

Referring now to FIG. 1, a conveyor assembly 10 is generally illustrated. The conveyor assembly 10 includes a conveyor 14, a process dolly 40, and a syncing apparatus 100 coupled to the process dolly 40. The conveyor 14 of the illustrated embodiment is a floor conveyor. That is the floor conveyor is positioned in a floor or at floor level. While the illustrated embodiment shows a floor conveyor, embodiments of the present disclosure may be equally applicable to other types of conveyors including, elevated or overhead conveyors.

The conveyor 14 may include a work part conveyor portion 18 and a person conveyor portion 16. The work part conveyor portion 18 and the person conveyor portion 16 may move parallel to one another at the same rate. Stated another way, the work part conveyor portion 18 and the person conveyor portion 16 move together in synchronization. The person conveyor portion 16 may allow a person to stand on the conveyor 14 at a desired location and move in synchronization with a work part 30 (e.g., a vehicle chassis) being carried along the work part conveyor portion 18. In some embodiments there may be a person conveyor portion 16 on either side of the work part conveyor portion 18, such as illustrated in FIG. 1.

Between the work part conveyor portion 18 and the person conveyor portion 16 may be a stationary track 24. A second stationary track 22 may be positioned at an outside edge of the person conveyor portion 16, such that stationary tracks 22, 24 are positioned parallel to and on both sides of the person conveyor portion 16 of the conveyor 14. As will be described with reference to the process dolly 40, the stationary tracks 22, 24 allow for the process dolly 40 to remain stationary relative to motion of the conveyor 14 prior to synchronization with a contact feature of the conveyor 14.

Figure 2:
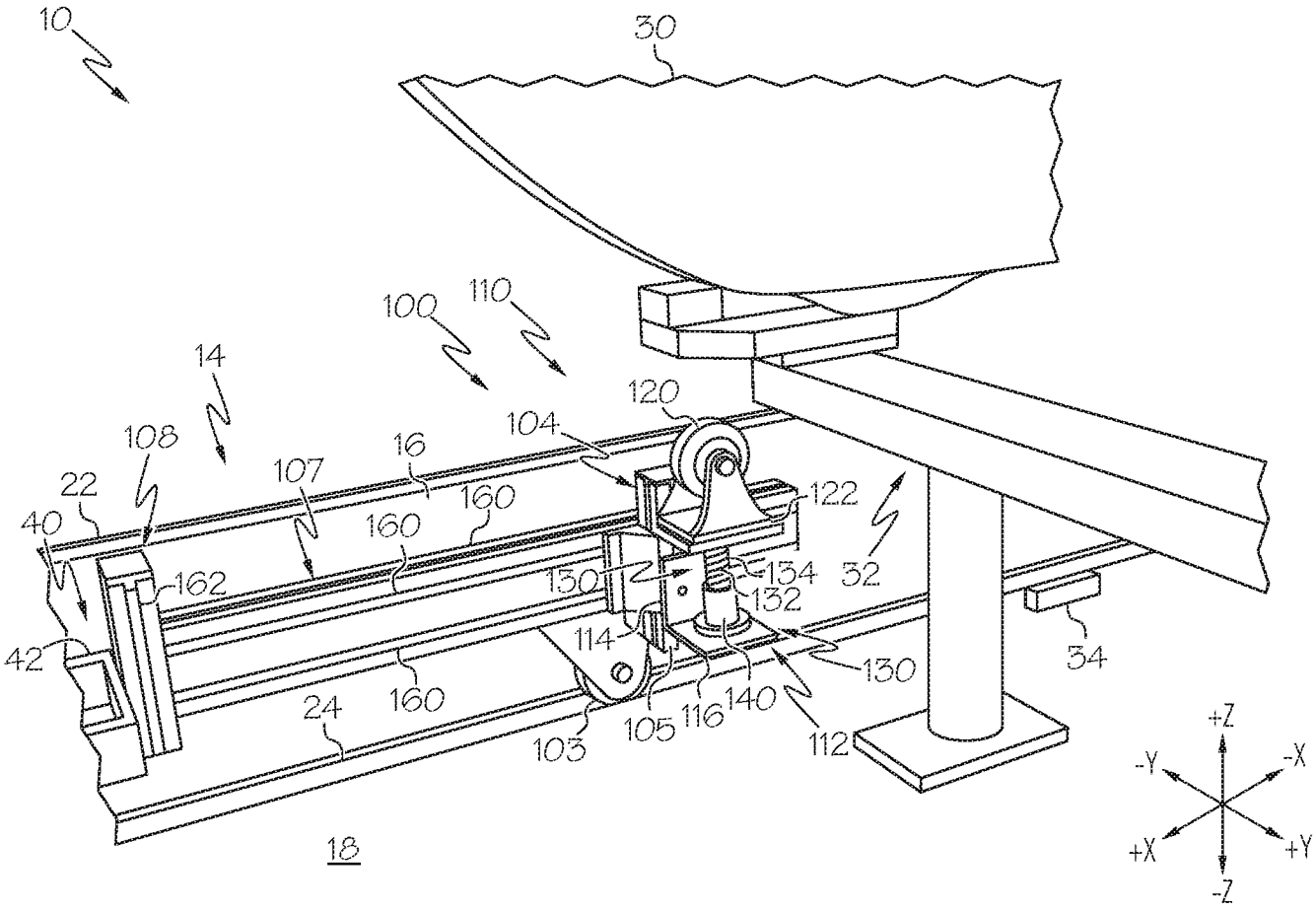
FIG. 2 depicts the conveyor assembly of FIG. 1 from an interior perspective, according to one or more embodiments shown and described herein.

FIG. 2 illustrates a view of the conveyor assembly 10 from underneath the work part 30. Illustrated in FIG. 2 are various objects coupled to the conveyor 14 that may be used as a contact feature for synchronizing a movement of the process dolly 40 to a movement of the conveyor 14. Accordingly, the contact feature of the conveyor 14 may be any object that moves in synchronization with the conveyor 14. For example, the contact feature may be an object that is coupled either the work part conveyor portion 18 or the person conveyor portion 16. The contact feature need not be a dedicated feature of the conveyor 14. Instead, the contact feature may have a dual purpose. For example, the contact feature may be a part pedestal 32 that is configured to support the work part 30 thereon. However, other contact features are also contemplated and possible. For example, a second contact feature, block 34, is illustrated as coupled to the work part conveyor portion 18 of the conveyor 14 proximate to the stationary track 24. As will be described in further detail below, the syncing apparatus 100 may be adjusted so as to be able to come in contact with any desired contact feature.

The process dolly 40 in both FIGS. 1 and 2 is illustrated as positioned upstream of the pedestal 32 in the +X direction of the depicted coordinate axes. Referring again to FIG. 1, the process dolly 40 may include a frame 42 and wheels 44 rotatably coupled to the frame 42. The frame 42 may be configured to hold tools, parts, and the like for use on work parts 30 (e.g., a vehicle chassis) traveling along the conveyor 14. The wheels 44 of the process dolly 40 may sit within the stationary tracks 22, 24 such that the process dolly 40 is isolated from movement of the conveyor 14 until the process dolly 40 is synchronized with a contact feature of the conveyor 14. When synchronized, the wheels 44 of the process dolly 40 can rotate within the stationary tracks 22, 24 and traverse the stationary tracks 22, 24 in synchronization with the movement of the conveyor 14.

Figure 3B:
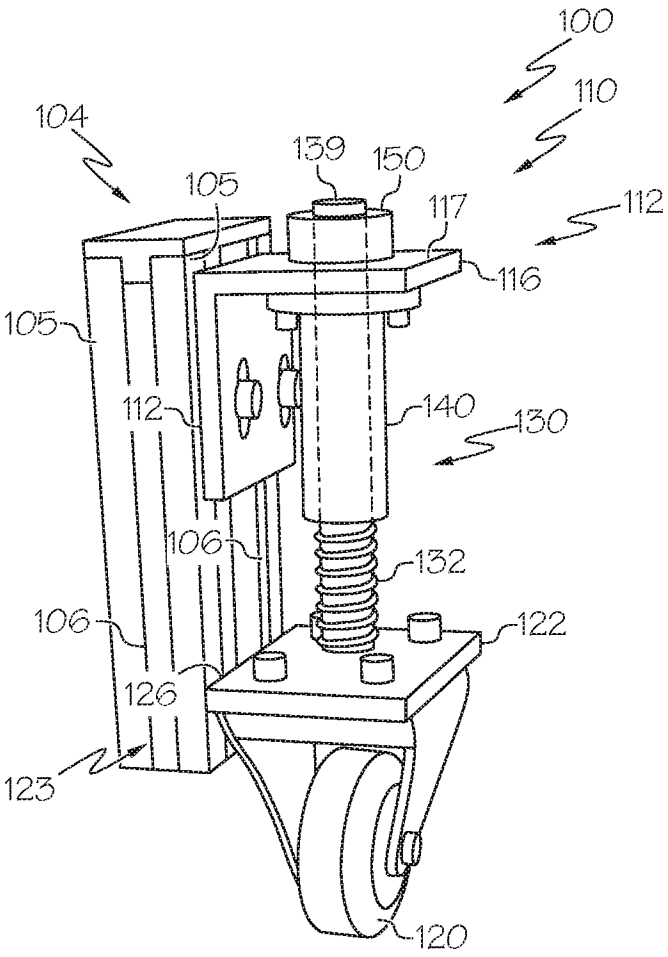
FIG. 3B depicts a perspective view of the syncing apparatus of FIG. 3A, according to one or more embodiments shown and described herein.
Figure 3A:
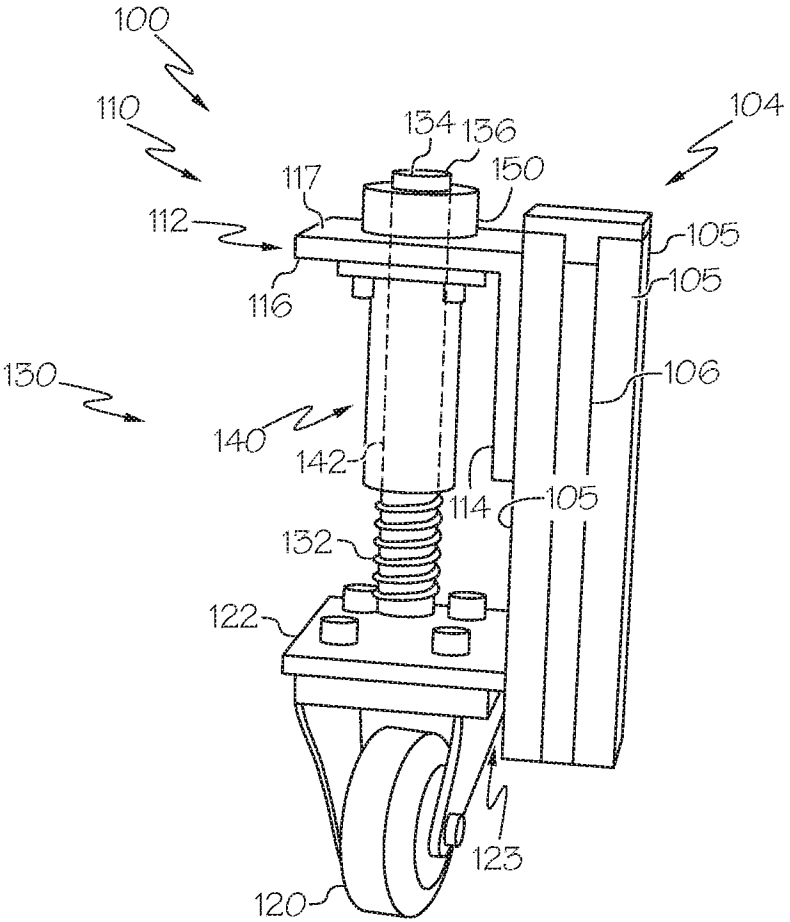
FIG. 3A depicts a front view of a syncing apparatus, according to one or more embodiments shown and described herein.

FIGS. 3A and 3B illustrate the syncing apparatus 100 for synchronizing the process dolly 40 with a movement of the conveyor 14. The syncing apparatus 100 includes a mounting frame 104 and a sync arm 110 coupled to the mounting frame 104. As will be described in greater detail herein, and as illustrated in FIGS. 4A-4D, contact between the sync arm 110 and a contact feature of the conveyor 14 may synchronize the process dolly 40, which is attached to the syncing apparatus 100, to a movement of the conveyor 14.

The mounting frame 104 may be any structure that is capable of mounting the sync arm 110 to the process dolly 40. For example, referring also to FIG. 2, illustrating a syncing apparatus 100 mounted to a process dolly 40, the mounting frame 104 may be a bracket that is mountable onto a frame 42 of the process dolly 40 either directly or through multiple mounting frames. Referring again to FIGS. 3A and 3B, the mounting frame 104 may define mounting grooves 106 that extend along a length of the mounting frame 104. For example, the mounting frame 104 may include one or more mounting surfaces 105 and each mounting surface 105 may include one or more mounting grooves 106 extending along a length of each mounting surface 105 of the mounting frame 104. The mounting grooves 106 may facilitate mounting of the sync arm 110 to the mounting frame 104 as well as allowing adjustment of the position of the sync arm 110 relative to the mounting frame 104. The mounting frame 104 may be produced from extruded aluminum.

The mounting frame 104 may be mountable to the frame 42 of the process dolly 40 through fasteners or the like. For example, one or more of the mounting grooves 106 may facilitate coupling of the mounting frame 104 to the process dolly 40. In some embodiments, and as noted above, multiple mounting frames may be used. Referring again to FIG. 2, a perspective view of the syncing apparatus 100 coupled to the frame 42 of the process dolly 40 from underneath the work part 30 is illustrated. In the illustrated embodiments, the mounting frame 104 may be a first mounting frame 104 that is adjustably coupled to a second mounting frame 107. The second mounting frame 107 may have a similar structure to mounting frame 104 and include mounting grooves 160 to facilitate mounting of the first mounting frame 104 to the second mounting frame 107 anywhere along the mounting grooves 160. In embodiments, the second mounting frame 107 may be directly mounted to the process dolly 40 or, as shown in FIG. 2 the second mounting frame 107 may be mounted to the process dolly 40 through a third mounting frame 108 also having one or more mounting grooves 162 formed therein. Any number of mounting frames may be used to mount the sync arm 110 to the frame 42 of the process dolly 40. Using various mounting frames may allow a user to customize the position of the sync arm 110 relative to the process dolly 40 such that the process dolly 40 is positioned in a desired position relative to the work part 30 traveling along the conveyor 14. In some embodiments, a support wheel 103 may be mounted to one of the mounting frames (e.g., the second mounting frame 107 in the illustrated embodiment of FIG. 2) to provide additional support to the syncing apparatus 100. The support wheel 103 may sit within the stationary track 24 so as not to move with the conveyor 14 until the sync arm 110 contacts a contact feature of the conveyor 14.

Referring again to FIGS. 3A and 3B, the sync arm 110 is adjustably coupled to the mounting frame 104. For example, the sync arm 110 is adjustably coupled to the mounting frame 104 through a support bracket 112. The support bracket 112 may be an L-shaped bracket having a bracket support arm 114 configured to be coupled to the mounting frame 104 and a sync support arm 116 that supports movement of the sync arm 110. The bracket support arm 114 and the sync support arm 116 may be positioned perpendicularly to one another.

The bracket support arm 114 is configured to interface with a mounting surface 105 of the mounting frame 104. The bracket support arm 114 may be configured to allow a fastener to pass therethrough and into a mounting groove 106 of the mounting frame 104. In some embodiments, multiple fasteners can extend from the bracket support arm 114 into multiple mounting grooves 106 of the mounting frame 104. The position of the support bracket 112 along the mounting grooves 106 of the mounting frame 104 can be adjusted, which adjusts the position of the bracket support arm 114 relative to the mounting frame 104. The fasteners can then be tightened at a desired location to prevent unwanted movement of the support bracket 112 relative to the mounting frame 104.

The sync arm 110 generally includes a wheel 120 and a biasing member 130 operatively coupled to the wheel 120 and configured to bias the wheel 120 to an extended position. As will be described in greater detail, the wheel 120 is configured to contact the contact feature of the conveyor 14 to synchronize the process dolly 40 to the movement of the conveyor 14 when the wheel 120 is biased to the extended position. Compression of the biasing member 130 moves the wheel 120 to a retracted position wherein the wheel 120 is configured to traverse the contours of the contact feature and lose contact with the contact feature such that the dolly is unsynchronized from the movement of the conveyor 14.

The wheel 120 may be a caster wheel that includes a wheel support frame 122. The wheel support frame 122 may rigidly align the wheel 120 in a rolling direction such that contact with the wheel 120 does not cause the wheel 120 swivel.

To support motion of the wheel 120 from an extended position to a retracted position, the biasing member 130 may include a linear bearing 140, an alignment rod 134, and a helical spring 132. The linear bearing 140 may be fixed relative to the mounting frame 104. For example, and as illustrated in FIGS. 3A and 3B, the linear bearing 140 may be coupled to the sync support arm 116 of the support bracket 112. As will be described in greater detail, the linear bearing 140 defines a bearing passage through which the alignment rod 134 may translate.

The alignment rod 134 may be coupled to the wheel support frame 122 of the wheel 120 at one end and, as described above, extend through the linear bearing 140 to a free end 136, wherein the alignment rod 134 is translatable relative to the linear bearing 140. In particular, the alignment rod 134 extends through the bearing passage of the linear bearing 140. In some embodiments, the sync support arm 116 may define an aperture therethrough that is aligned with the bearing passage of the linear bearing 140. Accordingly, the alignment rod 134 may pass through both the bearing passage of the linear bearing 140 and the aperture of the sync support arm 116 and be translatable therethrough. Both FIGS. 3A and 3B illustrate the sync arm 110 in an extended position. As illustrated, when in the extended position the free end 136 of alignment rod 134 extends beyond an outer surface 117 of the sync support arm 116.

In some embodiments, a stopper 150 may be coupled to the free end 136 of the alignment rod 134 at a position beyond the outer surface 117 of the sync support arm 116. In some embodiments, the stopper 150 may be adjustably mounted on to the free end 136 of the alignment rod 134. For example, the stopper 150 may be positioned along the alignment rod 134 to adjust the effective length of the alignment rod 134 capable of moving through the linear bearing 140. In other embodiments, it is contemplated that the stopper 150 may be tightly or otherwise immovably coupled to the free end 136 of the alignment rod 134. To limit linear motion of the alignment rod 134 through the linear bearing 140, the stopper 150 may have a dimension greater than a diameter of the aperture of the sync support arm 116, such that when the sync arm 110 is biased to the extended position, the stopper 150 contacts an outer surface 117 of the sync support arm 116 of the support bracket 112 and prevents further movement of the alignment rod 134 through the sync support arm 116 and the linear bearing 140.

In some embodiments, to prevent rotation of the wheel 120 about an axis defined by the alignment rod 134, a rotation stop 123 may be provided. The rotation stop 123 may be any object capable of preventing rotation of the wheel 120 about the alignment rod 134. In some embodiments, the rotation stop 123 may be a dedicated object coupled to the wheel 120, the wheel support frame 122, or the alignment rod 134, for example. In other embodiments, the wheel support frame 122 may be the rotation stop 123. For example, in the present embodiment the wheel support frame 122 includes a contact edge 126 positioned proximate to the mounting surface 105 of the mounting frame 104. In some embodiments, the contact edge 126 may be positioned in contact with the mounting surface 105 of the mounting frame 104. Accordingly, the interface between the contact edge 126 of the wheel support frame 122 and the mounting surface 105 of the mounting frame 104 may substantially prevent axial rotation of the wheel 120 about the axis defined by the alignment rod 134.

The helical spring 132 of the biasing member 130 may circumscribe the alignment rod 134 between the wheel support frame 122 and the linear bearing 140 so as to be compressed between the wheel support frame 122 and the linear bearing 140. The helical spring 132 may accordingly exert a force on the wheel support frame 122 and the linear bearing 140 to bias the wheel 120 to the extended position. The force applied by the spring 132 may be adjusted by moving the stopper 150 closer to or farther from the free end 136 of the alignment rod 134. For example, moving the stopper 150 farther down the alignment rod 134 would effectively shorten the length of the alignment rod 134 that the spring 132 extends along, which may cause greater compression in the spring 132. However, moving the stopper 150 farther up the alignment rod 134 toward the free end 136 would effectively lengthen the length of the alignment rod 134 that the spring 132 extends along, which may reduce the compression experienced by the spring 132.

Referring again to FIG. 2, as noted herein, contact between the syncing apparatus 100 and a contact feature of the conveyor 14 causes the process dolly 40 to become synchronized to a movement of the conveyor 14. The conveyor 14 may have multiple contact features coupled to thereto. In embodiments, the sync arm 110 of the syncing apparatus 100 is coupled to the mounting frame 104 so as to contact a desired contact feature. For example, as noted above, the contact feature of the conveyor 14 may be the part pedestal 32 coupled to the work part conveyor portion 18 of the conveyor 14. In such embodiments, the wheel 120 of the syncing apparatus 100 is directed upward so as to be able to contact the part pedestal 32. However, when, for example, block 34 is utilized as the contact feature, the wheel 120 of the syncing apparatus 100 may be directed downward so as to be able to contact the block 34.

Figure 4A:
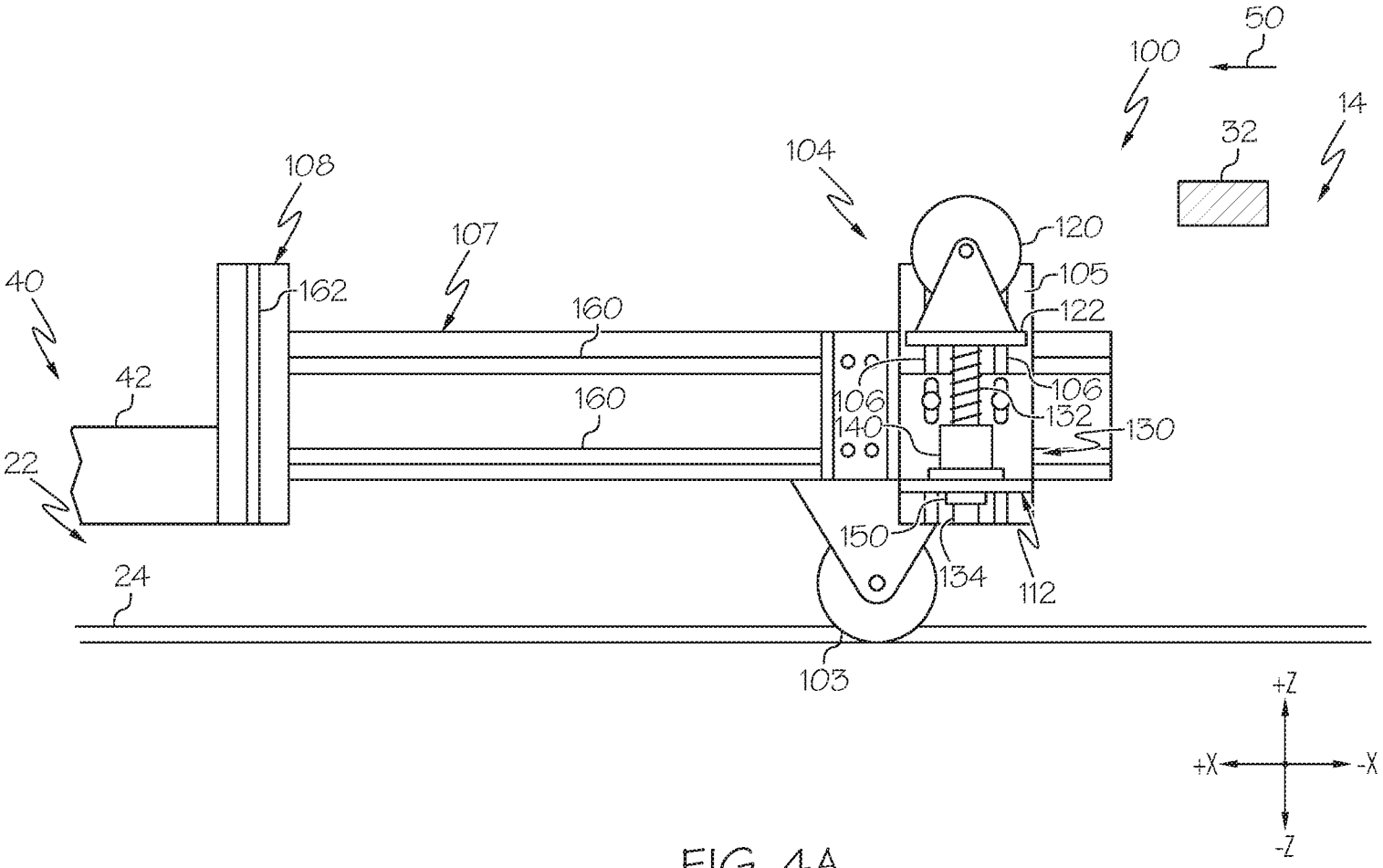
FIG. 4A depicts a side view of a syncing apparatus prior to contact with a contact feature of a conveyor, according to one or more embodiments shown and described herein.
Figure 4B:
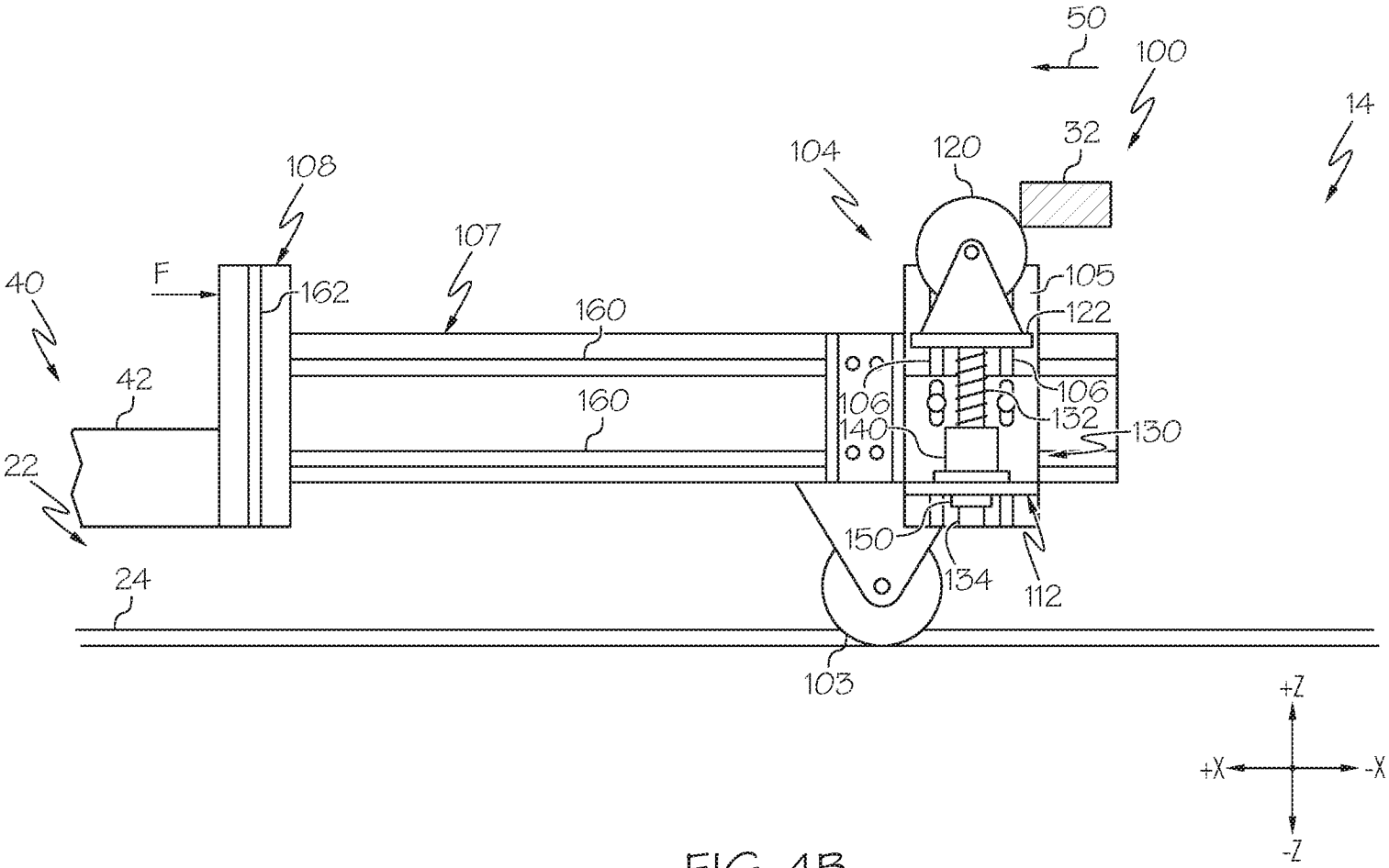
FIG. 4B depicts a side view of the syncing apparatus of FIG. 4A synchronized to a movement of the contact feature of the conveyor, according to one or more embodiments shown and described herein.
Figure 4C:
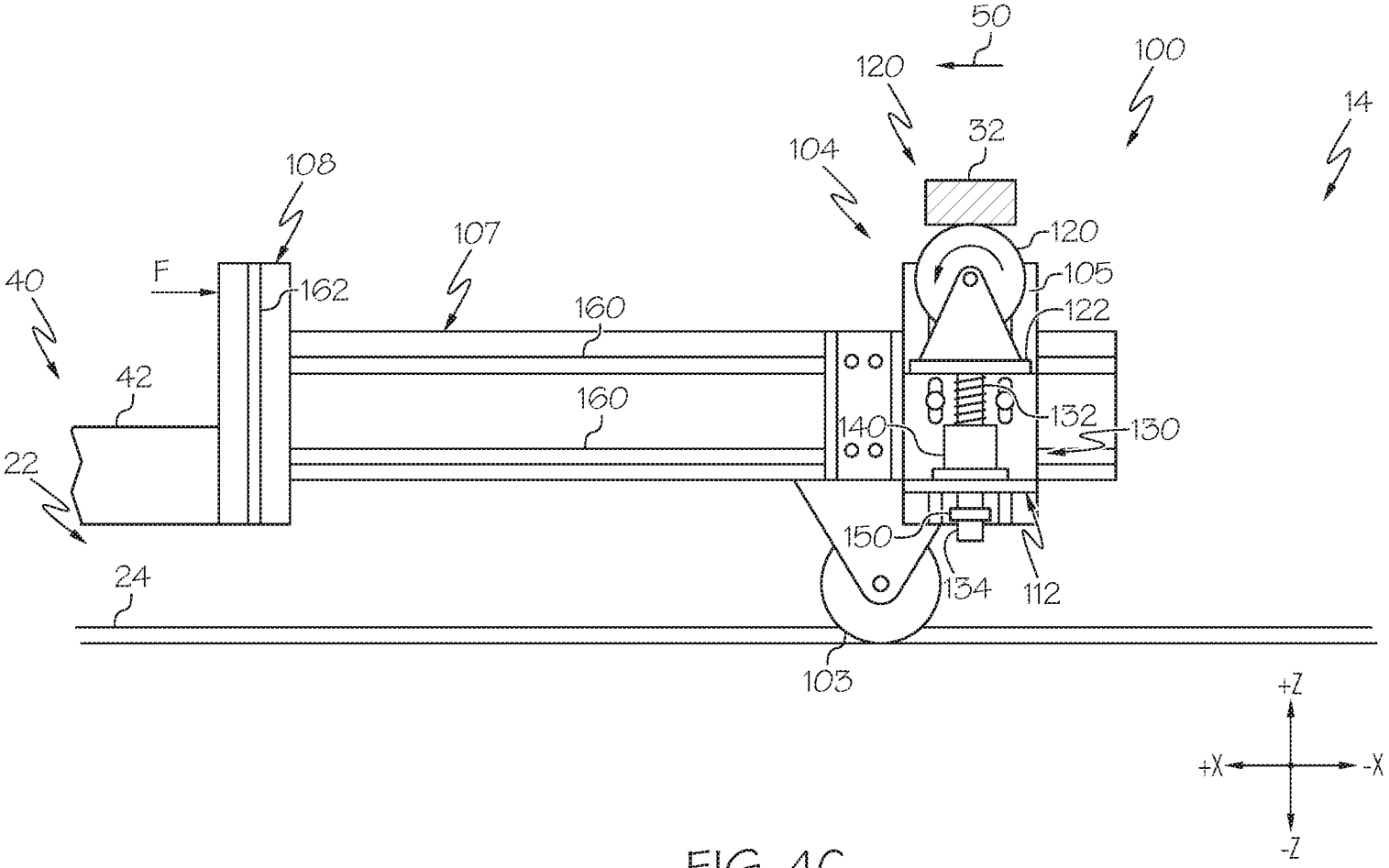
FIG. 4C depicts a side view of the syncing apparatus of FIG. 4B retracted to desynchronize from the contact feature of the conveyor assembly, according to one or more embodiments shown and described herein.
Figure 4D:
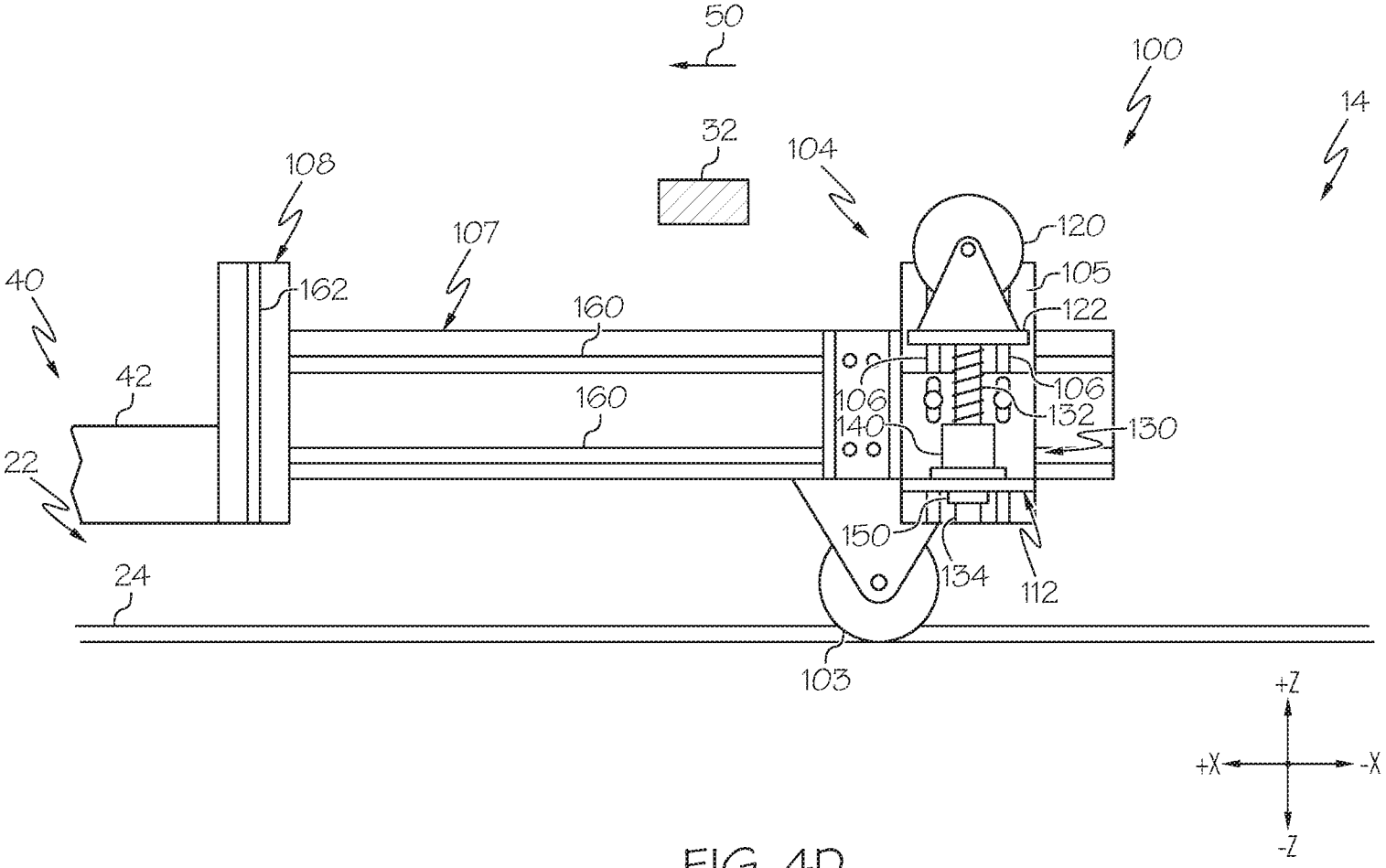
FIG. 4D depicts a side view of the syncing apparatus of FIG. 4C after desynchronization from the contact feature of the conveyor assembly, according to one or more embodiments shown and described herein.

FIGS. 4A-4D illustrates the synchronization of the process dolly 40 to the contact feature (e.g., part pedestal 32) of the conveyor 14 with the syncing apparatus 100. In FIG. 4A the process dolly 40 is positioned upstream of the movement of the conveyor 14, indicated by arrow 50. In FIG. 4B the contact feature of the conveyor 14 has contacted the wheel 120 of the contact feature. This contact between the wheel 120 and the part pedestal 32 causes the process dolly 40 to move along the stationary track 22 in synchronization with the movement of the conveyor 14. Accordingly the process dolly 40 and the conveyor 14 are moving in the direction of arrow 50. When the process dolly 40 is no longer needed, a force F can be applied to the process dolly 40 or the syncing apparatus 100 in a direction opposite of to the movement of the conveyor 14 (arrow 50). The wheel 120 is positioned at a height relative to the contact feature such that the application of the force F and friction between the wheel 120 and the contact feature causes the wheel 120 to rotate and compress under the part pedestal 32. Referring to FIG. 4C, the wheel 120 is illustrated as compressed under the part pedestal 32. Specifically, as the wheel 120 is pushed under the part pedestal 32, the wheel 120 is pushed downward, which causes the alignment rod 134 to move through the linear bearing 140, and the helical spring 132 to be compressed between the wheel support frame 122 and the linear bearing 140. As illustrated the stopper 150 is now spaced from the sync support arm 116 of the support bracket 112. In this retracted configuration, the wheel 120 is able to traverse the contours of the contact feature of the conveyor 14. Referring to FIG. 4D, once the contact feature has moved past the wheel 120 of the syncing apparatus 100, the wheel 120 is able to move back to the extended position due to the biasing force provided by the biasing member 130 of the syncing apparatus 100. The process dolly 40 is, thus, unsynchronized from the movement of the conveyor 14. The process dolly 40 may then be synchronized to a subsequent contact feature of the conveyor 14.

It should now be understood that embodiments described herein are directed to a syncing apparatus for synchronizing a process dolly to a movement of the conveyor. In particular, syncing apparatuses according to the present disclosure generally include a wheel and a biasing member coupled to the wheel and configured to bias the wheel to an extended position. When biased to the extended position, the wheel may contact a contact feature of the conveyor such that the process dolly, to which the syncing apparatus is attached, moves with the contact feature of the conveyor. When synchronization is no longer needed, force can be applied to the process dolly in a direction opposite the direction of movement of the conveyor. The contact feature may be positioned at such a height relative to the wheel that the force causes the wheel to roll over the contours of the contact feature while the biasing element allows the wheel of move to a retracted state such that the wheel remains in contact with the contact feature until it traverses completely past the contact feature. Accordingly, due to the rolling of the wheel over the contact feature, the syncing apparatus experiences much less wear than previous methods that used resilient urethane scrapers to contact a conveyor contact feature.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A syncing apparatus for synchronizing a process dolly to a conveyor, the syncing apparatus comprising:
- a mounting frame configured to be mounted to a frame of the process dolly; and
- a sync arm coupled to the mounting frame, the sync arm comprising:
  - a wheel; and
  - a spring coupled to the wheel and configured to bias the wheel to an extended position, wherein:
    - the wheel is configured to contact a contact feature of the conveyor to synchronize the process dolly to a movement of the conveyor when biased to the extended position; and
    - compression of the spring moves the wheel to a retracted position wherein the wheel is configured to traverse the contact feature of the conveyor and the process dolly is unsynchronized from the movement of the conveyor.

2. The syncing apparatus of claim 1, wherein the sync arm is adjustably coupled to the mounting frame.

3. The syncing apparatus of claim 1, further comprising a support bracket coupling the sync arm to the mounting frame, wherein the support bracket is adjustably coupled to the mounting frame.

4. The syncing apparatus of claim 1, wherein the spring is a helical spring.

5. The syncing apparatus of claim 1, wherein
- the wheel comprises a wheel support frame; and
- the sync arm further comprises:
  - a linear bearing configured to be fixed relative to the mounting frame; and
  - an alignment rod coupled to the wheel support frame and extending through the linear bearing, wherein the alignment rod is translatable relative to the linear bearing, wherein the spring is a helical spring circumscribing the alignment rod between the wheel support frame and the linear bearing to bias the wheel to the extended position.

6. The syncing apparatus of claim 5, further comprising a support bracket coupling the sync arm to the mounting frame, wherein the support bracket comprises:

a bracket support arm configured to be coupled to the mounting frame; and a sync support arm comprising an aperture formed therein, wherein the alignment rod passes through the aperture and is translatable relative to the aperture.

7. The syncing apparatus of claim 6, further comprising a stopper coupled to a free end of the alignment rod and having a dimension greater than a diameter of the aperture, wherein the stopper limits a linear motion of the alignment rod through the aperture.

8. The syncing apparatus of claim 6, further comprising a rotation stop configured to prevent axial rotation of the wheel about an axis defined by the alignment rod.

9. A process dolly, comprising:

a frame, and a syncing apparatus coupled to the frame and configured to synchronize the process dolly to a movement of a conveyor, wherein the syncing apparatus comprises a sync arm comprising:

a wheel; and a spring coupled to the wheel, the spring biasing the wheel to an extended position, wherein:

the wheel is configured to contact a contact feature of the conveyor to synchronize the process dolly to the movement of the conveyor; and compression of the spring moves the wheel to a retracted position wherein the wheel traverses the contact feature of the conveyor and the process dolly is unsynchronized from the movement of the conveyor.

10. The process dolly of claim 9, wherein the syncing apparatus is adjustably coupled to the frame.

11. The process dolly of claim 9, further comprising a mounting frame mounted to the frame and coupling the syncing apparatus to the frame.

12. The process dolly of claim 11, wherein:

the wheel of the syncing apparatus comprises a wheel support frame; and the sync arm of the syncing apparatus further comprises:

a linear bearing configured to be fixed relative to the mounting frame;

an alignment rod coupled to the wheel support frame and extending through the linear bearing, wherein the alignment rod is translatable relative to the linear bearing, wherein the spring is a helical spring circumscribing the alignment rod between the wheel support frame and the linear bearing to bias the wheel to the extended position.

13. The process dolly of claim 12, wherein the syncing apparatus further comprises a support bracket coupling the sync arm to the mounting frame, wherein the support bracket comprises:

a bracket support arm configured to be coupled to the mounting frame; and a sync support arm comprising an aperture formed therein, wherein the alignment rod passes through the aperture and is translatable relative to the aperture.

14. The process dolly of claim 13, wherein the syncing apparatus further comprises a stopper coupled to a free end of the alignment rod and having a dimension greater than a diameter of the aperture, wherein the stopper limits a linear motion of the alignment rod through the aperture.

15. The process dolly of claim 12, wherein the syncing apparatus further comprises a rotation stop configured to prevent rotation of the about an axis defined by the alignment rod.

16. A conveyor assembly comprising:

a conveyor having a contact feature; and a process dolly configured to be synchronized to a movement of the conveyor, the process dolly comprising:

a frame, and a syncing apparatus coupled to the frame and configured to synchronize the process dolly to the movement of the conveyor, the syncing apparatus comprises a sync arm comprising:

a wheel; and a spring coupled to the wheel, the spring biasing the wheel to an extended position, wherein:

the wheel is configured to contact the contact feature of the conveyor to synchronize the process dolly to the movement of the conveyor; and compression of the biasing member spring moves the wheel to a retracted position wherein the wheel traverses the contact feature of the conveyor and the process dolly is unsynchronized from the movement of the conveyor.

17. The conveyor assembly of claim 16, further comprising a mounting frame mounted to the frame of the process dolly and coupling the syncing apparatus to the frame of the process dolly wherein:

the wheel of the syncing apparatus comprises a wheel support frame; and the sync arm of the syncing apparatus comprises:

a linear bearing configured to be fixed relative to the mounting frame;

an alignment rod coupled to the wheel support frame and extending through the linear bearing, wherein the alignment rod is translatable relative to the linear bearing, and wherein the spring is a helical spring circumscribing the alignment rod between the wheel support frame and the linear bearing to bias the wheel to the extended position.

18. The conveyor assembly of claim 17, wherein the syncing apparatus further comprises a support bracket coupling the sync arm to the mounting frame, wherein the support bracket comprises:

a bracket support arm configured to be coupled to the mounting frame; and a sync support arm comprising an aperture formed therein, wherein the alignment rod passes through the aperture and is translatable relative to the aperture.

19. The conveyor assembly of claim 18, wherein the syncing apparatus further comprises a stopper coupled to a free end of the alignment rod and having a dimension greater than a diameter of the aperture, wherein the stopper limits a linear motion of the alignment rod through the aperture.

20. The conveyor assembly of claim 17, wherein the syncing apparatus further comprises a rotation stop configured to prevent rotation of the about an axis defined by the alignment rod.

* * * * *